US005890410A

United States Patent [19]

Hinojosa

[11] Patent Number: 5,890,410

[45] Date of Patent: Apr. 6, 1999

[54] HOLDING ASSEMBLY FOR CUTTING BLADE

[76] Inventor: Domingo Hinojosa, 23851 Douglas Dr., Plainfield, Ill. 60544

[21] Appl. No.: 820,635

[22] Filed: Mar. 19, 1997

[51] Int. Cl.[6] ..... B26D 1/62

[52] U.S. Cl. ..... 83/698.41; 83/698.61; 83/699.11

[58] Field of Search ..... 83/698.51, 698.41, 83/698.61, 698.71, 699.11

[56] References Cited

U.S. PATENT DOCUMENTS

| | | | |
|---|---|---|---|
| 2,751,006 | 6/1956 | Lane | 83/698.41 |
| 3,527,123 | 9/1970 | Dovey . | |
| 3,705,526 | 12/1972 | Bishop . | |
| 3,793,918 | 2/1974 | Huffman | 83/698.41 |
| 3,857,314 | 12/1974 | Gregoire | 83/698.51 |
| 3,926,084 | 12/1975 | Blazer | 83/698.41 |
| 3,935,774 | 2/1976 | Craddy . | |
| 4,131,047 | 12/1978 | Schriber et al. . | |
| 4,187,753 | 2/1980 | Walde | 83/698.41 |
| 4,467,687 | 8/1984 | Fokos et al. | 83/698.51 |
| 4,475,425 | 10/1984 | Punater et al. . | |
| 4,594,928 | 6/1986 | Thomas et al. . | |
| 4,781,668 | 11/1988 | Mowry | 83/698.61 |
| 4,932,298 | 6/1990 | Capdebosco | 83/698.61 |
| 4,998,829 | 3/1991 | Greer | 83/698.51 |
| 5,029,505 | 7/1991 | Holiday | 83/699.11 |
| 5,119,707 | 6/1992 | Fischer | 83/698.41 |
| 5,159,868 | 11/1992 | Thomas et al. | 83/698.41 |
| 5,211,096 | 5/1993 | Steidinger | 83/698.61 |
| 5,224,408 | 7/1993 | Steidinger . | |
| 5,275,076 | 1/1994 | Greenwalt . | |
| 5,282,409 | 2/1994 | Rojas . | |
| 5,357,836 | 10/1994 | Strömberg et al. . | |
| 5,367,936 | 11/1994 | Held et al. | 83/698.61 |

*Primary Examiner*—M. Rachuba
*Assistant Examiner*—Sean A. Pryor
*Attorney, Agent, or Firm*—Wood, Phillips, VanSanten, Clark & Mortimer

[57] ABSTRACT

A holding assembly for maintaining a blade in an operative position on a movable support, which holding assembly has an elongate housing assembly having a first wall with a first pressure applying surface facing transversely to the length of the elongate housing assembly in a first direction, and a plate assembly having a second wall with a second pressure applying surface. With the elongate housing assembly and plate assembly in operative relationship, the first and second pressure applying surfaces face oppositely to each other so that there is a thickness between the first and second pressure applying surfaces. The first and second walls are repositionable selectively towards and away from each other with the elongate housing assembly and plate assembly in operative relationship to thereby vary the thickness between the first and second pressure applying surfaces. The holding assembly further includes a slide bar between a part of the elongate housing assembly and a part of the plate assembly that is guided by at least one of the elongate housing assembly and plate assembly in movement relative to the at least one of the elongate housing assembly and plate assembly lengthwise of the elongate housing assembly. The slide bar has first and second discrete cam surfaces spaced from each other lengthwise relative to the elongate housing assembly. Second and third cam surfaces are provided on at least one of the elongate housing assembly and plate assembly. The second and third cam surfaces cooperate one each with the first and second cam surfaces to cause the first and second walls to be wedged away from each other as the slide bar is moved in one direction lengthwise relative to the elongate housing assembly to thereby vary the thickness between the first and second pressure applying surfaces.

19 Claims, 4 Drawing Sheets

T
10
134
136
42
40
44
12
24
18
T
46
34
28
36
30
38
14
48
130
32
26
142
22
138
20
140
132
128
16

HOLDING ASSEMBLY FOR CUTTING BLADE

BACKGROUND OF THE INVENTION

1. Field of the Invention

This invention relates to cutting blades, such as those used to perforate or sever a paper web and, more particularly, to an assembly for holding a blade on a carrier therefor in such a manner that assembly, disassembly and adjustment of the blade are facilitated.

2. Background Art

There are many environments in which cutting blades are used. In one exemplary system, cutting blades are used to perforate or sever a continuous paper web. In these types of systems, it is known to provide a rotary cylinder with at least one slot through a peripheral surface thereof that defines the blade mounting location. The slot typically has a circumferential dimension that is substantially greater than the thickness of the blade so that the slot will accommodate both the blade and a holding assembly for the blade.

A myriad of different blade holding assemblies have been devised and remain in use today. Most of these assemblies are designed to fit loosely within the slot together with the blade and are reconfigurable to be captively held, together with the blade, in the slot.

With the blade in an operative position on the cylinder, the blade projects radially beyond the peripheral cylinder surface. As the cylinder rotates, the cutting edge on the blade is brought repetitively into close proximity to an underlying anvil to penetrate a web moving between the blade and the anvil. The blade may be configured to make perforating cuts in the web or to cut fully through the web. The cylinder diameter and location of the blade(s) on the periphery of the cylinder are selected to produce a desired spacing between successive cuts as the cylinder rotates.

Specifications for many cutting operations demand that the size and depth of the cuts produced by the blade be precise. This may necessitate that the blade be sharp and consistently oriented on the cylinder at all times.

To maintain a sharp blade, regular sharpening or replacement may be required. In most cases, this will involve removal of the active blade for sharpening or replacement. To replace the active blade, the holding assembly is reconfigured to allow the blade to be released. The same reconfiguration of the holding assembly is required to adjust the blade, which must initially be loosened and then re-secured after the appropriate reorientation has been carried out.

The design of the blade holding assemblies is key to efficient overall system operation. Blade replacement and adjustment both require that the cylinder be stopped, in turn requiring that the entire system operating in conjunction with the cutting cylinder be shut down.

While minimizing down time is a key consideration in the design of a blade holding assembly, it is also important that a holding assembly be capable of positively holding a blade precisely in its intended orientation. Any compromise on the blade position may lead to faulty cutting and/or premature blade failure, both of which compromise overall system performance.

An overriding objective in the design of blade holding systems is that they be user friendly. Systems that are difficult to operate, or in which blade adjusting procedures are time consuming, will inevitably encourage users to avoid this task. As a result, improperly aligned blades and dull blades may be left in place longer than is practical.

One exemplary prior art system is shown in U.S. Pat. No. 4,131,047 (Schriber et al). In Schriber et al, the user is required to rotate a relatively large number of screws to reconfigure the blade holding apparatus to release the blade and to re-secure the blade. In the one embodiment, five such screws are shown which apparently must each be loosened and tightened to adjust and replace the blades. Aside from the inconvenience of having to turn that many screws, the system appears to be prone to blade misalignment. Since there is no practical way to place and maintain the blade and blade holding system in a desired orientation and simultaneously tighten the screws, the screws must be tightened one by one. If the first screw is tightened with the blade system misaligned, there may be no way to straighten the blade without loosening the first tightened screw. The user may tighten a large number of the screws and only then determine that there is a misalignment of the blade which may require that all of the tightened screws be loosened and re-tightened. Rather than loosen the screws to carry out the necessary alignment, the user may be tempted to proceed with a misaligned blade.

Other exemplary systems are shown in U.S. Pat. Nos. 3,527,123; 3,705,526; 3,935,774; 4,131,047; 4,475,425; 4,594,928; 5,224,408; 5,275,076; 5,282,409; and 5,357,836.

SUMMARY OF THE INVENTION

In one form of the invention, a holding assembly is provided for maintaining a blade in an operative position on a movable support, which holding assembly has an elongate housing assembly having a first wall with a first pressure applying surface facing transversely to the length of the elongate housing assembly in a first direction, and a plate assembly having a second wall with a second pressure applying surface. With the elongate housing assembly and plate assembly in operative relationship, the first and second pressure applying surfaces face oppositely to each other so that there is a thickness between the first and second pressure applying surfaces. The first and second walls are repositionable selectively towards and away from each other with the elongate housing assembly and plate assembly in operative relationship to thereby vary the thickness between the first and second pressure applying surfaces. The holding assembly further includes a slide bar between a part of the elongate housing assembly and a part of the plate assembly that is guided by at least one of the elongate housing assembly and plate assembly in movement relative to the at least one of the elongate housing assembly and plate assembly lengthwise of the elongate housing assembly. The slide bar has first and second discrete cam surfaces spaced from each other lengthwise relative to the elongate housing assembly. Second and third cam surfaces are provided on at least one of the elongate housing assembly and plate assembly. The second and third cam surfaces cooperate one each with the first and second cam surfaces to cause the first and second walls to be wedged away from each other as the slide bar is moved in one direction lengthwise relative to the elongate housing assembly to thereby vary the thickness between the first and second pressure applying surfaces.

The cam surfaces may have a cylindrical or spherical shape. Other shapes are contemplated.

In one form, there is a discrete cylindrical element or a discrete spherical element defining at least one of the cam surfaces.

A drive assembly can be provided to forcibly move the slide bar in the one lengthwise direction.

The drive assembly may have a drive element with a drive surface that is threadably connected to the elongate housing assembly, with there being an intermediate element between the drive element and slide bar. The drive element surface acts against the intermediate element and biases the intermediate element to cause the slide bar to move in the one direction as an incident of the drive element being rotated in one direction.

The slide bar may be defined by first and second discrete elements which define the first and second cam surfaces, with there being a spacer that maintains a predetermined spacing between the first and second discrete elements, with the spacer and first and second discrete elements being fully separable, each from the other.

In one form, the plate assembly has at least two discrete elements which define the third and fourth cam surfaces, with there being a spacer that maintains a predetermined spacing between the two discrete elements, with the spacer and the at least two discrete elements being fully separable, each from the other.

In one form, the plate assembly has an elongate plate that is fixedly attached to the spacer, with the second wall being defined by the elongate plate.

In one form, a pin extends through the elongate housing assembly into a slot in the spacer on the plate assembly to maintain the elongate housing assembly and the plate assembly in the operative relationship, with the slide bar being captively maintained between the part of the elongate housing assembly and the part of the plate assembly with the elongate housing assembly and plate assembly in the operative relationship.

In one form, the elongate housing assembly has a receptacle for accepting substantially the entire plate assembly and slide bar.

In one form, a spring element acts between the elongate housing assembly and the slide bar to normally urge the slide bar oppositely to the one direction relative to the elongate housing assembly.

A separate, hardened metal plate can be interposed between the slide bar and the part of the elongate housing assembly.

The invention further contemplates that a second plate assembly and second slide bar can be provided which are structurally the same as the first claimed slide bar and plate assembly. The second plate assembly and second slide bar cooperate with each other and the elongate housing assembly in the same manner as the first claimed plate assembly and slide bar cooperate with each other and the elongate housing assembly.

The holding assembly can be provided in combination with a blade and a rotating cylinder, with the rotating cylinder having a rotational axis, a peripheral surface, and a slot in the peripheral surface, with there being first and second facing holding surfaces bounding the slot. The blade is abutted to the second pressure applying surface, with the blade and holding assembly being captively held between the first and second holding surfaces with a holding force that is variable by changing the thickness between the first and second pressure applying surfaces.

In another form of the invention, a holding assembly is provided for maintaining a blade in an operative position on a movable support, which holding assembly includes a housing assembly having a first wall with a first pressure applying surface facing in a first direction and a plate assembly having a second wall with a second pressure applying surface. With the housing assembly and plate assembly in operative relationship, the first and second pressure applying surfaces face oppositely to each other so that there is a thickness between the first and second pressure applying surfaces. The first and second walls are repositionable selectively towards and away from each other with the housing assembly and plate assembly in operative relationship to thereby vary the thickness between the first and second pressure applying surfaces. First and second discrete cam surfaces are guided between a part of the plate assembly and a part of the housing assembly in a first line between the first and second pressure applying surfaces. Third and fourth discrete cam surfaces on at least one of the plate assembly and the housing assembly cooperate one each with the first and second discrete cam surfaces to cause the first and second walls to be wedged away from each other as the first and second discrete cam elements are moved in one direction along the first line relative to the housing assembly. A drive system forcibly moves the first and second discrete cam elements in the one direction.

A second plate assembly can be provided having a third wall with a third pressure applying surface. With the housing assembly and second plate assembly in operative relationship, the first and third pressure applying surfaces face oppositely to each other so that there is a thickness between the first and third pressure applying surfaces. The first and third walls are repositionable selectively towards and away from each other with the housing assembly and second plate assembly in operative relationship to thereby vary the thickness between the first and third pressure applying surface. Fifth and sixth discrete cam surfaces are guided between a part of the second plate assembly and a part of the housing assembly in a second line that is substantially parallel to the first line between the first and third pressure applying surfaces. Seventh and eighth discrete cam surfaces on at least one of the second plate assembly and the housing assembly cooperate one each with the fifth and sixth discrete cam surfaces to cause the first and third walls to be wedged away from each other as the fifth and sixth discrete elements are moved along the second line oppositely to the one direction.

The drive system may include a drive element that is repositionable to simultaneously force the first and second discrete cam surfaces in the first line in the one direction and the fifth and sixth discrete cam surfaces in the second line opposite to the one direction.

The first, second, third, fourth, fifth, sixth, seventh, and eighth discrete cam surfaces may each be defined by one of a discrete spherical element and a discrete cylindrical element.

DETAILED DESCRIPTION OF THE DRAWINGS

Figure 1:
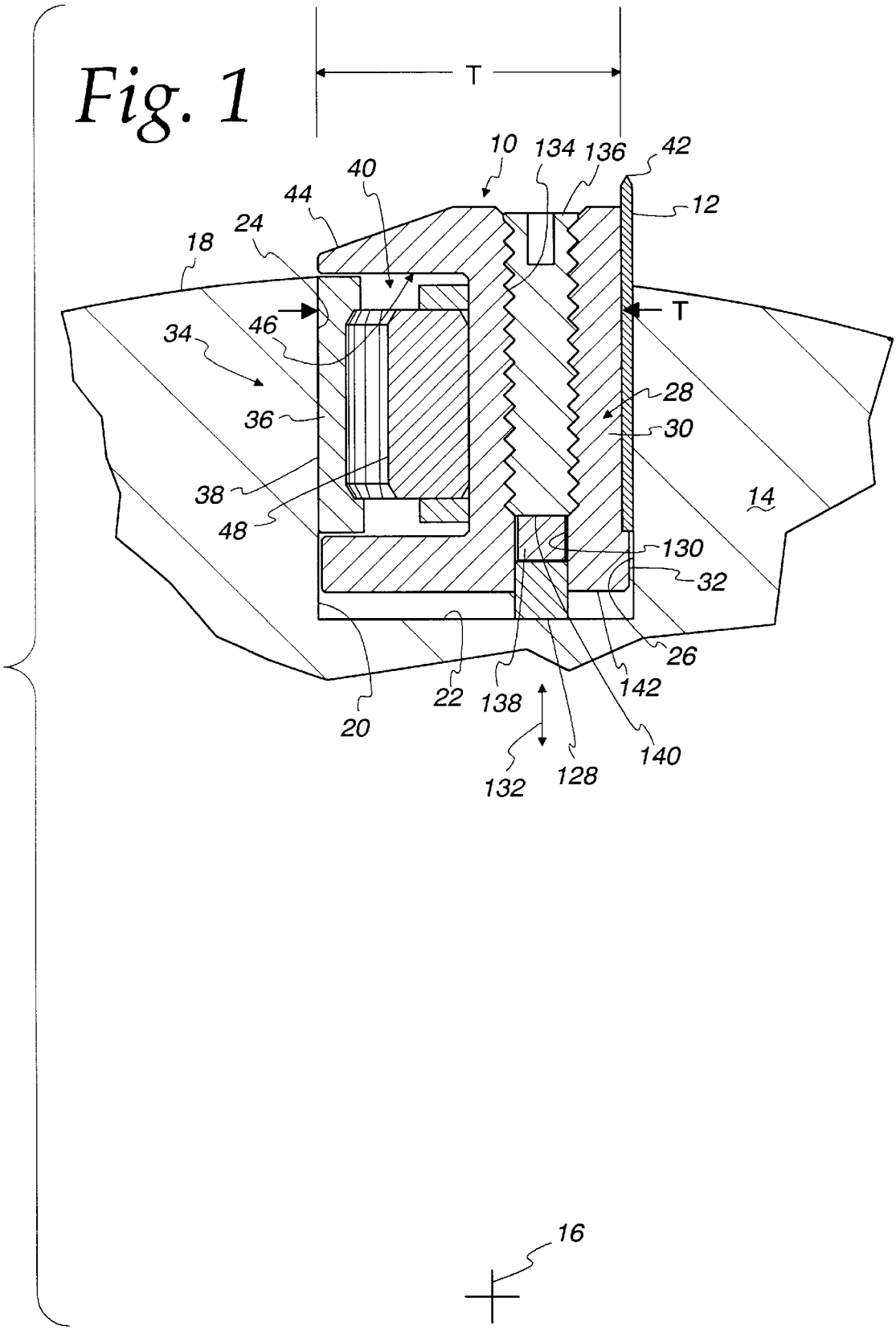
FIG. 1 is a fragmentary, partial cross-sectional view of a rotary cylinder having a cutting blade mounted thereon through a holding assembly, according to the present invention.
Figure 2:
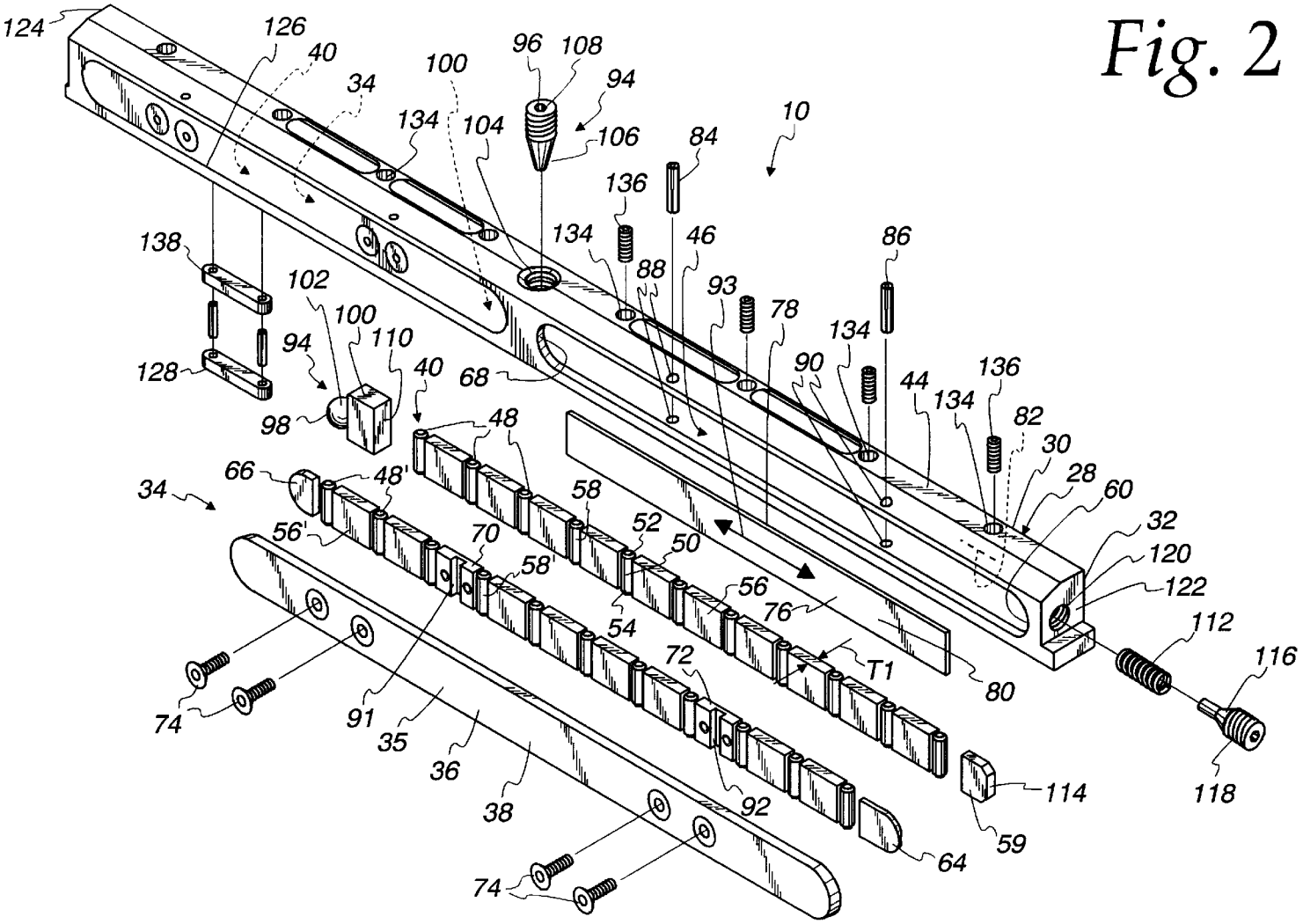
FIG. 2 is a reduced, exploded, perspective view of the blade holding assembly of FIG. 1.

In FIGS. 1–4, a preferred form of holding assembly is shown at 10 for maintaining a blade 12 in an operative position on a rotary cylinder 14. The cylinder 14 is but exemplary of one environment in which the present invention is useable, and should not be viewed as limiting.

The cylinder 14 is rotatable about an axis 16. The cylinder 14 has a peripheral surface 18 with an undercut slot 20 therethrough extending along substantially the entire axial extent of the peripheral surface 18. The slot 20 is bounded by a radially facing bottom surface 22 and two facing holding surfaces 24, 26, which, in conjunction with the bottom surface 22, define a "U" shape in cross section.

As explained in greater detail below, the blade holding assembly 10 has an elongate housing assembly 28 with a first wall 30 having a first pressure applying surface 32 facing transversely to the length of the elongate housing assembly 28 in a first direction. A plate assembly 34 has an elongate plate 35 with a second wall 36 defining a second pressure applying surface 38. With the elongate housing assembly 28 and plate assembly 34 in the operative relationship of FIG. 1, the first and second pressure applying surfaces 32, 38 face oppositely to each other to produce a combined thickness T therebetween.

By repositioning a slide bar 40, as described in detail below, the relative position of the walls 30, 36 is variable to increase the thickness T between the first and second pressure applying surfaces 32, 38. By so doing, the blade 12 becomes firmly captive between the first pressure applying surface 32 and the cylinder holding surface 26. The combined structure of the blade 12 and holding assembly 10 is in tun positively captively held between the holding surfaces 24, 26 in the operative position of FIG. 1.

With the blade 12 and the blade holding assembly 10 in the operative position of FIG. 1, the blade cutting edge 42 projects beyond the radially outermost extent of the blade holding assembly 10 and is thereby exposed to be repetitively brought into contact with an underlying paper web (not shown). As this occurs, the cutting edge 42 presses the web against an anvil (not shown) to form a cut therein.

Through the cooperation between the plate assembly 34, the housing assembly 28, and the slide bar 40, the spacing between the pressure applying surfaces 32, 38 can be varied. This cooperative arrangement will now be described in greater detail.

The housing assembly 28 has a body 44 with a recessed receptacle 46 configured to accept substantially the entire plate assembly 34 and slide bar 40 with the housing assembly 28, plate assembly 34 and slide bar 40 in operative relationship.

The slide bar 40 is made up of a plurality of discrete cam elements 48. In this case, eleven cam elements 48 are spaced at regular intervals along the length of the housing assembly 28. Each cam element 48 has a cylindrical body 50 with chamfered edges 52, 54 at the axial ends thereof. The axes of the cylindrical bodies 50 are substantially parallel to each other over the length of the slide bar 40.

Generally rectangular spacers 56 on the slide bar 40 are interposed between adjacent cam elements 48 to maintain the regular spacing. The spacers 56 have a thickness T1 that is less than the diameter of the bodies 50 of the cam elements 48. The cylindrical outer surface 58 on each cam element 48 functions as a cam surface. An end spacer 59 is configured to generally match the curved end surface 60 bounding the receptacle 46.

The plate assembly 34 consists of the aforementioned wall 36 and a series of cam elements 48' that have the same configuration as the cam elements 48 defining the slide bar 40. Spacers 56', having the same configuration as the spacers 56, are interposed between adjacent cam elements 48'. The cam elements 48' likewise each have a cylindrical cam surface 58', with the axes of the cam surfaces 58' being parallel. End spacers 64, 66 conform to the end surfaces 60 and 68, respectively, bounding the receptacle 46.

The plate 35 is connected to two spacers 70, 72 through screws 74. The spacers 72 define a rigid support against which the remainder of the spacers 56' and cam elements 48' can be urged, and perform a retaining function, as described below.

To place the slide bar 40, the plate assembly 34, and housing assembly 28 in operative relationship, a hardened metal plate 76 is first directed into the receptacle 46. The plate 76 has oppositely facing flat surfaces 78, 80. The flat surface 78 is placed facially against a flat surface 82 defining the base of the receptacle 46. The slide bar 40, including the cam elements 48 and spacers 56, is then placed against the plate surface 80. The plate assembly 34, including the wall 36, the cam elements 48', and the spacers 56', 64, 66, 70, 72, is then introduced into the receptacle 46 and directed against the slide bar 40.

Once the housing assembly 28, plate assembly 34, and slide bar 40 are placed in the operative relationship, pins 84, 86 are directed through bores 88, 90 in the housing body 44 and thereby through slots 91, 92 in the spacers 70, 72, respectively, aligned with the bores 88, 90. Through this arrangement, the plate assembly 34 is held on the housing assembly 28 and the slide bar 40 becomes captive between the plate assembly 34 and the plate 76.

Figure 3:
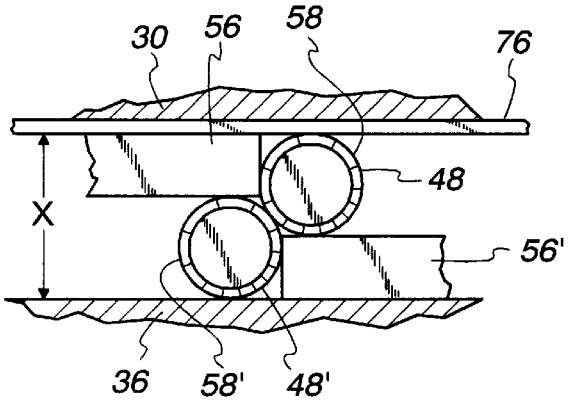
FIG. 3 is an enlarged, fragmentary, schematic representation of the cooperation between cam elements on the blade holding assembly in FIGS. 1 and 2, with the blade holding assembly in an unlocked state.
Figure 4:
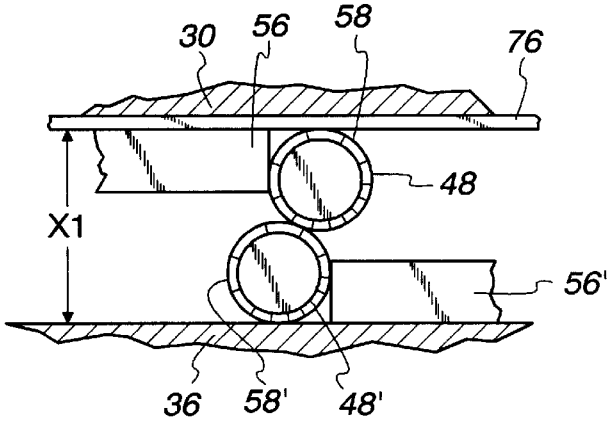
FIG. 4 is a view as in FIG. 3 with the cam elements situated so that the blade holding assembly is in a locked state.

With the plate assembly 34, slide bar 40 and housing assembly 28 in the operative relationship, the slide bar 40 is allowed to move guidingly between part of the housing assembly 28 and part of the plate assembly 34 in the direction of the double-headed arrow 93, i.e. parallel to the length of the housing assembly 44, within a limited range. Within that limited range, the cam elements 48, 48' can be moved between a first relative position, shown in FIG. 3, wherein the cam element surfaces 58, 58' abut but do not produce any appreciable camming action, and that shown in FIG. 4, wherein the surfaces 58, 58' wedge the walls 30, 36 away from each other to thereby vary the thickness between the pressure applying surfaces 32, 38 between a dimension X as shown in FIG. 3, and a larger dimension X1, as shown in FIG. 4.

There are a corresponding number of cam elements 48, 48' so that the camming action is produced between each of the cam elements 48, 48' along the length of the holding assembly 10. This accounts for an even holding force distribution along the length of the blade holding assembly 10 and a very positive "locking" of the holding assembly 10 and blade 12 within the slot 20.

To effect shifting of the slide bar 40, a drive assembly 94 is provided. The drive assembly 94 consists of a threaded drive element 96 and an intermediate element 98 between the drive element 96 and the slide bar 40. The intermediate element 98 consists of a squared block 100 having a spherical surface 102 at one end thereof The element 98 resides adjacent to the end surface 68 bounding the receptacle 46 so that the spherical surface 102 is in the path of the drive element 96 advancing through a threaded a bore 104 in the housing body 44.

The drive element 96 has a conical surface 106 which engages the spherical surface 102. The drive element 96 has a receptacle 108 for a tool (not shown) which allows the drive element 96 to be positively rotated within the threaded bore 104. Rotation of the drive element 96 in one direction causes the conical surface 106 to move against the spherical surface 102 and thereby progressively cam the block 100 from left to right in FIG. 2. As the block 100 shifts, a flat face 110 on the block 100 moves against the slide bar 40 to effect shifting thereof between the FIG. 3 (unlocked) and FIG. 4 (locked) positions, thereby increasing the spacing between the pressure applying surfaces 32, 38 to secure the holding assembly 10 in the slot 20.

The slide bar 40 is normally biased to the unlocked position by a coil spring 112. The coil spring 112 is captively maintained in a biased state between a surface 114 on the end spacer 59 and a plug 116 with external threads 118 thereon to engage threads within a bore 120. By advancing the plug 116 into the bore 120, the bias force produced by the spring 112 is increased. The plug 116 also adjustably limits movement of the slide bar 40 to the right in FIG. 2 within the receptacle 46.

While a single plate assembly 34 and slide bar 40 can be used according to the invention, in a more preferred form, at least two cooperating plate assemblies 34 and slide bars 40 are used. In this case, the bore 104 is located centrally between the housing assembly ends 122, 124. A second receptacle 126, configured the same as the receptacle 46, is provided between the bore 104 and the housing end 124. A second slide bar 40 and second plate assembly 34, having the same configuration as the slide bar 40 and plate assembly 34, previously described, are placed in operative relationship with each other and the housing assembly 28 in the same manner as previously described, within the receptacle 126. A second mounting block 100 is also located within the receptacle 126. The only significant modification required in mounting the slide bar 40 and plate assembly 34 in the receptacle 126 is that a) the block 100 is reversed so that the flat face 110 faces the housing end 124 and b) the end location of the end spacers 59, 64, 66 is reversed.

With this arrangement the drive element 96 simultaneously shifts the slide bar 40 in the receptacle 46 towards the housing end 122 and the slide bar 40 in the receptacle 126 towards the housing end 124. Accordingly, the user can, with one hand, place and hold down the holding assembly 10, and with the other hand rotate the drive element 96. The holding assembly 10 thus becomes firmly locked along its entire extent between the ends 122, 124. If for any reason the holding assembly 10 is improperly aligned, by simply reversing the rotation of the drive element 96, the holding assembly 10 can be reconfigured to be shifted, together with the blade 12, within the slot 20. Not only does this simplify blade assembly, disassembly, and adjustment, but it also makes possible a safer system design than those requiring multiple bolt tightening.

Proper and consistent alignment of the holding assembly 10 within the slot 20 is further facilitated by providing cushioned spacing feet 128 on the housing assembly 28. The spacing feet 128 are located in receptacles 130 which are configured to allow the spacing feet 128 to shift in the direction of the double-headed arrow 132 within the receptacles 130. The receptacles 130 are spaced regularly along the length of the housing body 44. A corresponding number of bores 134 are formed in the housing body 44 and communicate to the receptacles 130. The bores 134 are threaded to accept height adjustment screws 136. A metal pusher 138 is disposed in each receptacle 130 between the screw 136 and the spacing feet 128. The bottom 140 of each screw 136 abuts to the metal pusher 138 and through the metal pusher 138 shifts the spacing feet 128 downwardly in FIG. 1 in the line of the arrow 132. By controlling the adjusting screw 136, the amount of projection of the spacing feet 128 beyond the housing surface 142 is determined.

Figure 5:
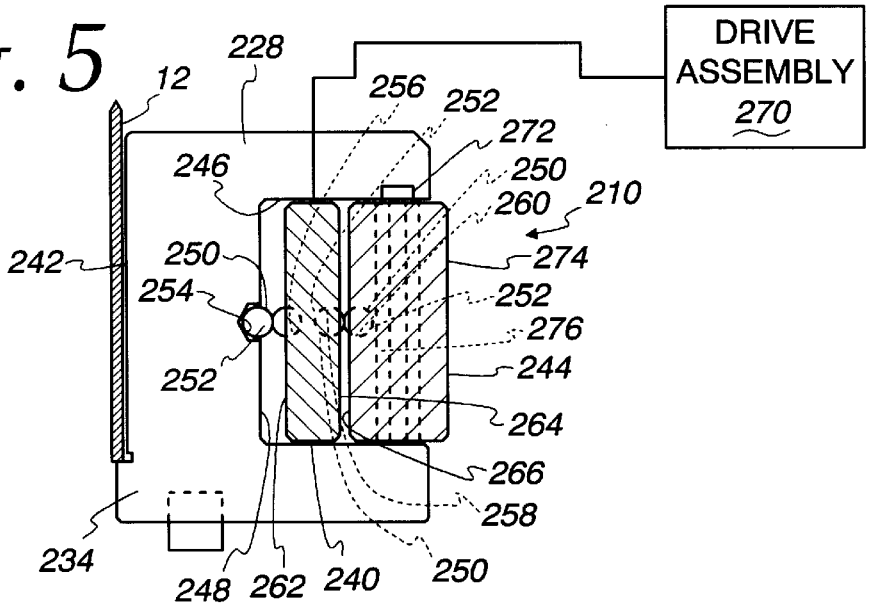
FIG. 5 is a cross-sectional view of a modified form of blade holding assembly, according to the present invention.

The invention contemplates variations of the above-described holding assembly 10 shown in FIGS. 1–4. In FIG. 5, another blade holding assembly, according to the present invention, is shown at 210. The blade holding assembly 210 is designed to hold the blade 12 in the slot 20 on the cylinder 14 in the same operative position as shown in FIG. 1. An elongate housing assembly 228 is designed to cooperate with a plate assembly 234 and slide bar 240 to control the spacing between oppositely facing pressure applying surfaces 242, 244 on the housing assembly 228 and the plate assembly 234, respectively. With the housing assembly 228, the plate assembly 234, and the slide bar 240 in operative relationship, the plate assembly 234 and slide bar 240 reside substantially entirely within a receptacle 246 defined by the housing assembly 228, with the slide bar 240 in this relationship being captive between a back surface 248 on the housing assembly 228 and the plate assembly 234. The slide bar 240 is movable guidingly in a lengthwise direction relative to the housing assembly 228 between the back surface 248 and the plate assembly 234.

In this embodiment, there are spherical cam elements 250 with spherical cam surfaces 252 used in place of the cylindrical cam elements 48, 48' on the blade holding assembly 10, previously described. The principle of operation is the same using the cam elements 250 in place of the cam elements 48, 48'. In this case, the cam elements 250 are strategically located in recesses/receptacles 254 in the housing assembly 228, recesses/receptacles 256, 258 in the slide bar 240, and recesses/receptacles 260 in the plate assembly 234. The cam elements 250 project from their associated recesses/receptacles 254, 256, 258, 260, with the spherical cam surfaces 252 on the cam elements 250 on the facing housing surface 248 and slide bar surface 262 cooperating to produce a first camming action and the cam surfaces 252 on the cam elements 250 on the facing surfaces 264, 266 on the slide bar 240 and plate assembly 234 cooperating to produce a second camming action.

A drive assembly 270, similar to the drive assembly 94, is used to forcibly shift the slide bar 240 to produce the above camming action. The system 210 can be modified by eliminating the cooperating cam elements 250 on one side of the slide bar 240, if desired.

In this embodiment, the slide bar 240 and plate assembly 234 each preferably utilize a single elongate piece to mount the cam elements 250. However, separate spacers and cam elements 250 can be used to define the slide bar 240 and plate assembly 234.

To maintain the housing assembly 228, the plate assembly 234, and the slide bar 240 in operative relationship, a plurality of holding pins 272 are used. The holding pins 272 extend through a body 274 on the housing assembly 228 and into a widened slot 276 formed through the plate assembly 234. By making the slot 276 with a diameter that is greater than the diameter of the pin 272, the plate assembly 234 is allowed to shift through the required range as effected through the cam elements 250.

Figure 6:
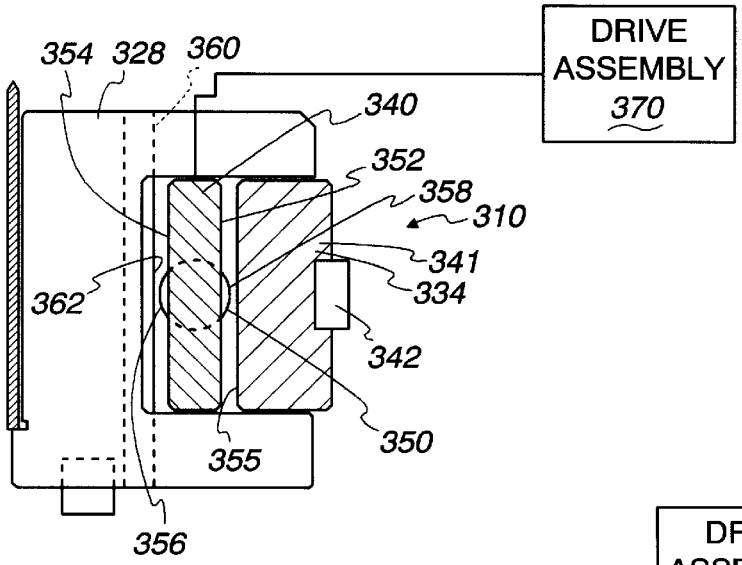
FIG. 6 is a view as in FIG. 5 showing a further modified form of blade holding assembly, according to the present invention.

A further modified form of blade holding assembly, according to the present invention, is shown at 310 in FIG. 6. The blade holding assembly 310 has an elongate housing assembly 328, a plate assembly 334, and a slide bar 340. In this embodiment, the plate assembly 334 has one main piece 341 and a polyurethane pad 342 which is recessed in the piece 341 and can be compressed against the cylinder surface 26.

The slide bar 340 uses a series of spherical cam elements 350 which each project from oppositely facing surfaces 352, 354 of the slide bar. The slide bar 340 can be made in pieces using spacers and the cam elements 350 or, alternatively, a single piece can be used into which the cam elements 350 are integrated by means well known to those skilled in the art.

That portion 358 of the cam element 350 projecting from the surface 352 performs a pushing function against the adjacent plate assembly surface 355. That portion 356 of the cam element 350 that projects from the surface 354 cooperates with strategically located pins 360 which have a cylindrical camming surface 362. A drive assembly 370 moves the slide bar 340.

Figure 7:
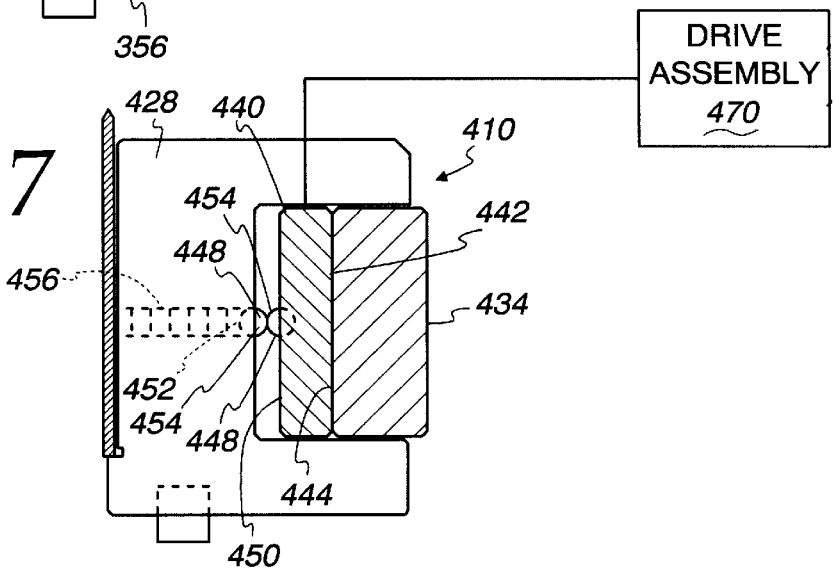
FIG. 7 is a view as in FIGS. 5 and 6 showing a further modified form of blade holding assembly, according to the present invention.

A further modified form of blade holding assembly is shown at 410 in FIG. 7. The blade holding assembly 410 has a housing assembly 428, plate assembly 434, and a slide bar 440. In this embodiment, a flat surface 442 on the slide bar 440 is facially abutted to a flat surface 444 on the plate assembly 434. Spherical cam elements 448 are provided along the length of the slide bar 444 and project from the surface 450. The slide bar 440 can be made as one piece or with spacers between the cam elements 448.

A recess/receptacle 452 accommodates a cam element 448, with the spherical cam surfaces 454 on the cam elements 448 cooperating to produce left to right movement in FIG. 7 of the slide bar 440 and plate assembly 434.

In this embodiment, a set screw 456 is provided to determine the degree of projection of the cam element 454 from the recess/receptacle 452. By increasing the amount of projection, the camming force can be increased as the slide bar 440 is shifted by a suitable drive system 470.

Figure 8:
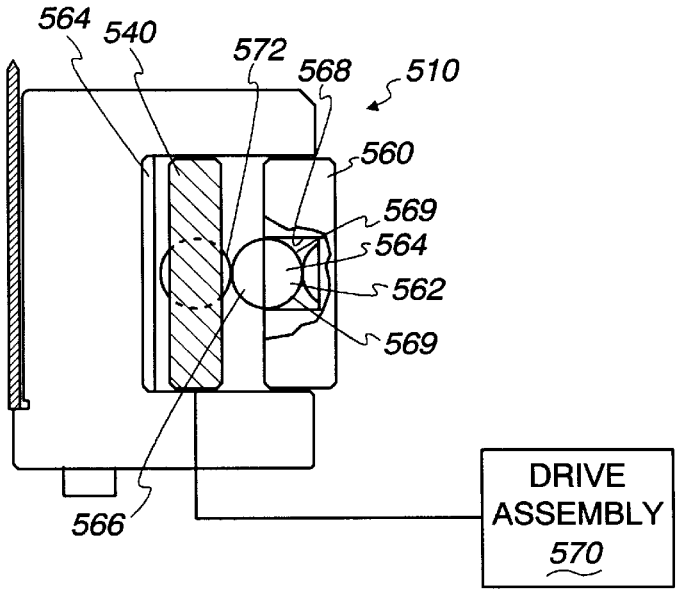
FIG. 8 is a view as in FIGS. 5–7 and showing a still further modified form of blade holding assembly, according to the present invention.

A still further modified form of blade holding assembly is shown at 510 in FIG. 8. The blade holding assembly 510 has a slide bar 540 and pins 564, similar to the slide bar 340 and pins 362 in the blade holding assembly 310. The principal difference in this embodiment is that a plate assembly 560, corresponding to the plate assembly 334, has a biased cam element 562 associated therewith. The cam element 562 has a cylindrical body 564 with a flat 566 formed thereon. The body 564 is movable into and out of a recess/receptacle 568 and is biased by a compression washer 569 towards the slide bar 540. As the slide bar 540 is shifted through a drive system 570, a spherical cam surface 572 on each cam element 574 acts against the flat 566 to progressively urge the cam element 574 towards the right in FIG. 8. Accordingly, there is a cam actuated biasing force exerted through the washer 569 to the plate assembly 560.

The invention contemplates other combinations of the basic elements described herein above. Suitable materials of construction can be readily determined by one skilled in the art. Conventional hardening of metals can be carried out for surfaces that are subjected to large camming forces.

The foregoing disclosure of specific embodiments is intended to be illustrative of the broad concepts comprehended by the invention.

We claim:

1. A holding assembly for maintaining a blade in an operative position on a movable support, said holding assembly comprising:

an elongate housing assembly having a length and a first wall with a first pressure applying surface facing transversely to the length of the elongate housing assembly in a first direction;

a plate assembly having a second wall with a second pressure applying surface, wherein the first and second pressure applying surfaces face oppositely to each other so that there is a thickness between the first and second pressure applying surfaces, the first and second walls being repositionable selectively towards and away from each other to thereby vary the thickness between the first and second pressure applying surfaces; and a slide bar between a part of the elongate housing assembly and a part of the plate assembly that is guided by at least one of the elongate housing assembly and plate assembly in movement relative to the at least one of the elongate housing assembly and plate assembly lengthwise of the elongate housing assembly, first and second discrete cam surfaces on the slide bar spaced from each other lengthwise relative to the elongate housing assembly, third and fourth cam surfaces on at least one of the elongate housing assembly and plate assembly, said third and fourth cam surfaces cooperating one each with the first and second cam surfaces to cause the first and second walls to be wedged away from each other as the slide bar is moved in one direction lengthwise relative to the at least one of the elongate housing assembly and plate assembly to thereby vary the thickness between the first and second pressure applying surfaces, wherein at least one of a) the first and second cam surfaces and b) the third and fourth cam surfaces are defined by first and second discrete elements that are spaced from each other lengthwise relative to the elongate housing assembly, wherein there is a spacer that maintains a predetermined spacing between the first and second discrete elements lengthwise relative to the elongate housing as the slide bar is moved lengthwise relative to the elongate housing assembly.

2. The blade holding assembly according to claim 1 wherein at least one of the cam surfaces has a cylindrical shape.

3. The blade holding assembly according to claim 1 wherein at least one of the cam surfaces has a spherical shape.

4. The blade holding assembly according to claim 1 including a drive assembly for forcibly moving the slide bar in the one lengthwise direction.

5. The blade holding assembly according to claim 4 wherein the drive assembly comprises a drive element that is threadably connected to the elongate housing assembly and has a drive surface, there being an intermediate element between the drive element and slide bar, the drive element surface acting against the intermediate element and biasing the intermediate element to cause the slide bar to move in the one lengthwise direction as an incident of the drive element being rotated in one direction.

6. The blade holding assembly according to claim 1 wherein the first and second discrete elements define the first and second discrete cam surfaces and the first and second discrete elements and spacer are fully separable, each from the other.

7. The blade holding assembly according to claim 1 wherein the first and second discrete elements define the third and fourth cam surfaces and the first and second discrete cam elements and spacer are fully separable, each from the other.

8. A blade holding assembly for maintaining a blade in an operative position on a movable support, said holding assembly comprising:

an elongate housing assembly having a length and a first wall with a first pressure applying surface facing transversely to the length of the elongate housing assembly in a first direction;

a plate assembly having a second wall with a second pressure applying surface, wherein the first and second pressure applying surfaces face oppositely to each other so that there is a thickness between the first and second pressure applying surfaces, the first and second walls being repositionable selectively towards and away from each other to thereby vary the thickness between the first and second pressure applying surfaces; and a slide bar between a part of the elongate housing assembly and a part of the plate assembly that is guided by at least one of the elongate housing assembly and plate assembly in movement relative to the at least one of the elongate housing assembly and plate assembly lengthwise of the elongate housing assembly, first and second discrete cam surfaces on the slide bar spaced from each other lengthwise relative to the elongate housing assembly, third and fourth cam surfaces on at least one of the elongate housing assembly and plate assembly, said third and fourth cam surfaces cooperating one each with the first and second cam surfaces to cause the first and second walls to be wedged away from each other as the slide bar is moved in one direction lengthwise relative to the at least one of the elongate housing assembly and plate assembly to thereby vary the thickness between the first and second pressure applying surfaces, wherein the plate assembly comprises at least two discrete elements which define the third and fourth cam surfaces, and a spacer that maintains a predetermined spacing between the two discrete elements, and the spacer and at least two discrete elements are fully separable, each from the other, wherein the plate assembly comprises an elongate plate that is fixedly attached to the spacer and the second wall is defined by the elongate plate.

9. The blade holding assembly according to claim 8 wherein there is a pin that extends through the elongate housing assembly and into a slot in the spacer to maintain the slide bar being captively between the part of the elongate housing assembly and the part of the plate assembly.

10. The blade holding assembly according to claim 1 in combination with a blade and a rotary cylinder, the rotary cylinder having a rotational axis, a peripheral surface and a slot in the peripheral surface having first and second facing holding surfaces, the blade is abutted to the second pressure applying surface and the blade and holding assembly are captively held between the first and second holding surfaces with a holding force that is variable by changing the thickness between the first and second pressure applying surfaces.

11. The blade holding assembly according to claim 1 wherein the elongate housing assembly has a receptacle for receiving substantially the entire plate assembly and slide bar.

12. The blade holding assembly according to claim 1 wherein a spring element acts between the elongate housing assembly and the slide bar to urge the slide bar oppositely to the one lengthwise direction relative to the elongate housing assembly.

13. The blade holding assembly according to claim 1 wherein there is a separate hardened metal plate between the slide bar and the part of the elongate housing.

14. The blade holding assembly according to claim 1 wherein there is a second plate assembly and a second slide bar, with the second plate assembly and second slide bar being structurally the same as the first claimed slide bar and first claimed plate assembly, said second plate assembly and second slide bar cooperating with each other and the elongate housing assembly in the same manner as the first claimed plate assembly and first claimed slide bar cooperate with each other and the elongate housing assembly.

15. A holding assembly for maintaining a blade in an operative position on a movable support, said holding assembly comprising:

a housing assembly having a length and a first wall with a first pressure applying surface facing in a first direction;

a plate assembly having a second wall with a second pressure applying surface, wherein the first and second pressure applying surfaces face oppositely to each other so that there is a thickness between the first and second pressure applying surfaces, the first and second walls being repositionable selectively towards and away from each other to thereby vary the thickness between the first and second pressure applying surfaces, first and second discrete cam surfaces that are guided between a part of the plate assembly and a part of the housing assembly in a first line between the first and second pressure applying surfaces, third and fourth discrete cam surfaces on at least one of the plate assembly and the housing assembly cooperating one each with the first and second discrete cam surfaces to cause the first and second walls to be wedged away from each other as the first and second discrete cam elements are moved in one direction along the first line relative to the housing assembly; and a drive system for selectively forcibly moving the first and second discrete cam elements in the one direction, wherein at least one of a) the first and second cam surfaces and b) the third and fourth cam surfaces are defined by first and second discrete elements that are spaced from each other lengthwise relative to the housing assembly, wherein there is a spacer between the first and second discrete elements to maintain a space therebetween lengthwise relative to the housing assembly and having a surface which guides at least one cam surface on the other of a) the first and second cam surfaces and b) the third and fourth cam surfaces as the first and second cam elements are moved along the first line relative to the housing assembly.

16. The blade holding assembly according claim 15 including a second plate assembly having a third wall with a third pressure applying surface, wherein with the housing assembly and second plate assembly in operative relationship, the first and third pressure applying surfaces face oppositely to each other so that there is a thickness between the first and third pressure applying surfaces, the first and third walls being repositionable selectively towards and away from each other with the housing assembly and second plate assembly in operative relationship to thereby vary the thickness between the first and third pressure applying surfaces, fifth and sixth discrete cam surfaces that are guided between a part of the second plate assembly and a part of the housing assembly in a second line that is substantially parallel to the first line between the first and third pressure surfaces, seventh and eighth discrete cam surfaces on at least one of the second plate assembly and the housing assembly cooperating one each with the fifth and sixth discrete cam surfaces to cause the first and third walls to be wedged away from each other as the fifth and sixth discrete elements are moved along the second line oppositely to the one direction.

17. The blade holding assembly according to claim 16 wherein the drive system comprises a single drive element that is repositionable to simultaneously force the first and second discrete cam surfaces in the one direction along the first line and the fifth and sixth discrete cam surfaces in the second line oppositely to the one direction.

18. The blade holding assembly according to claim 16 wherein the first, second, third, fourth, fifth, sixth, seventh, and eighth discrete cam surfaces are each defined by one of a discrete spherical element and a discrete cylindrical element.

19. A blade holding assembly for maintaining a blade in an operative position on a movable support, said holding assembly comprising:

an elongate housing assembly having a length and a first wall with a first pressure applying surface facing transversely to the length of the elongate housing assembly in a first direction;

a plate assembly having a second wall with a second pressure applying surface, wherein the first and second pressure applying surfaces face oppositely to each other so that there is a thickness between the first and second pressure applying surfaces, the first and second walls being repositionable selectively towards and away from each other to thereby vary the thickness between the first and second pressure applying surfaces; and a slide bar between a part of the elongate housing assembly and a part of the plate assembly that is guided by at least one of the elongate housing assembly and plate assembly in movement relative to the at least one of the elongate housing assembly and plate assembly lengthwise of the elongate housing assembly, first and second discrete cam surfaces on the slide bar spaced from each other lengthwise relative to the elongate housing assembly, third and fourth cam surfaces on at least one of the elongate housing assembly and plate assembly, said third and fourth cam surfaces cooperating one each with the first and second cam surfaces to cause the first and second walls to be wedged away from each other as the slide bar is moved in one direction lengthwise relative to the elongate housing assembly to thereby vary the thickness between the first and second pressure applying surfaces, wherein a spring element acts between the elongate housing assembly and the slide bar to urge the slide bar oppositely to the one direction lengthwise relative to the elongate housing assembly.

* * * * *